US008276668B2

(12) United States Patent
Vestavik

(10) Patent No.: US 8,276,668 B2
(45) Date of Patent: Oct. 2, 2012

(54) METHOD AND DEVICE FOR CLEANING AND SEALING A WELL

(75) Inventor: Ola M. Vestavik, Eggesbones (NO)

(73) Assignee: Reelwell AS (NO)

( * ) Notice: Subject to any disclaimer, the term of this patent is extended or adjusted under 35 U.S.C. 154(b) by 0 days.

(21) Appl. No.: 12/669,186

(22) PCT Filed: Jul. 16, 2008

(86) PCT No.: PCT/NO2008/000268

§ 371 (c)(1),
(2), (4) Date: Apr. 23, 2010

(87) PCT Pub. No.: WO2009/011594

PCT Pub. Date: Jan. 22, 2009

(65) Prior Publication Data

US 2010/0276143 A1 Nov. 4, 2010

(30) Foreign Application Priority Data

Jul. 17, 2007 (NO) ..... 20073681

(51) Int. Cl.
*E21B 37/00* (2006.01)

(52) U.S. Cl. ..... 166/312; 166/311; 166/380

(58) Field of Classification Search ..... 166/311, 166/312, 207, 380, 384; 15/3.5, 104.061, 15/104.05, 104.16
See application file for complete search history.

(56) References Cited

U.S. PATENT DOCUMENTS

| | | | | |
|---|---|---|---|---|
| 3,926,269 | A * | 12/1975 | Cullen et al. | 175/104 |
| 4,534,426 | A | 8/1985 | Hooper | |
| 5,280,766 | A * | 1/1994 | Mohn | 166/368 |
| 5,562,159 | A | 10/1996 | Smith | |
| 6,073,696 | A | 6/2000 | Ellis | |
| 6,315,498 | B1 * | 11/2001 | Baugh et al. | 405/184 |
| 6,883,605 | B2 | 4/2005 | Arceneaux et al. | |
| 6,892,829 | B2 * | 5/2005 | Livingstone | 175/57 |
| 7,055,627 | B2 | 6/2006 | Fontana et al. | |
| 7,077,213 | B2 * | 7/2006 | Cook et al. | 166/384 |
| 7,343,983 | B2 * | 3/2008 | Livingstone | 175/57 |
| 2005/0103527 | A1 | 5/2005 | Church | |
| 2006/0086507 | A1 | 4/2006 | Surjaatmadja | |

FOREIGN PATENT DOCUMENTS

| | | |
|---|---|---|
| CA | 2 260 710 | 8/2000 |
| GB | 2425136 | 10/2006 |
| WO | WO 2005/024173 | 3/2005 |

* cited by examiner

*Primary Examiner* — Cathleen Hutchins
*Assistant Examiner* — Richard Alker
(74) *Attorney, Agent, or Firm* — Adenike Adebiyi

(57) ABSTRACT

The present invention relates to a method for cleaning and possibly sealing a subsurface well. According to the method a multichannel tool string comprising an adapter on a first end of the tool string, a guide device at the second end of the tool string are run into the well, whereupon the guide device is activated in order to permit the well to be flushed by the supply of fluid through at least one of the channels in connection with the tool string and fluids and particles from the well are transported back to the surface through at least one other of the channels in connection with the tool string. The invention also relates to a device for cleaning and possibly sealing a subsurface well.

19 Claims, 6 Drawing Sheets

METHOD AND DEVICE FOR CLEANING AND SEALING A WELL

FIELD OF THE INVENTION

This invention relates to a method and device for cleaning and sealing a well in connection with drilling—and well operations.

BACKGROUND

A conventional method of cleaning a well is to flush it with fluid. To accomplish this, a long pipe, hereinafter called a tool string, is lowered into the well. The tool string is generally lowered to the bottom of the well, and may contain, for example, drilling tools, flushing tools, cementing tools, measuring tools and the like. When fluid is pumped from the surface down through the tool string to the bottom of the well, the fluid will return to the surface through the annular space on the outside of the tool string in the well, hereinafter called an annulus. The pumping causes particles from the drilling process or from other activities to be transported out of the well through the annulus on the outside of the tool string. Since the fluid velocity in the annulus is often low, the efficiency of the well cleaning performed in this manner will therefore also often be low.

The cleaning efficiency is usually low in the case of drilling and maintenance of wells with a large angular deviation from the vertical direction. This applies particularly to horizontal wells, where the particles have a tendency to be deposited in the lower part of the wellbore on account of gravity. This hampers the cleaning process and greatly prolongs the operation.

The cleaning efficiency is also often limited by low pressure or weak formation in the well, making it necessary to keep the fluid velocity in the annulus at a low level. This in order to avoid loss of drilling fluid or to prevent other dangerous well control situations from arising.

An alternative method of cleaning the well is so-called "reverse circulation". This means that instead of pumping fluid down through the tool string with return in the annulus, it is pumped in the opposite direction. "Reverse circulation" means that fluid is pumped down into the annulus and return fluid is taken from the well up through the tool string. This method has the advantage that particles entering the tool string are transported to the surface quickly and efficiently. With this method, however, the flushing effect in the bottom of the well is low, due to limitations in pressure for this.

A third alternative method of cleaning the well is to employ a double string, where one channel in the string is used for pumping fluid down into the well, while the other channel is used for the return flow from the well. This technique is employed for well operations with coilable pipes (coiled tubing), particularly for cleaning horizontal wells. The technique is also employed with double-walled screwed pipes, but is restricted to shallow wells with specific pressure ratios, since the pressure loss in the return flow pipe becomes too high for it to be used on a practical level for normal drilling.

Wells which are leaking also represent substantial problems, both in new wells in the process of establishment and in older wells on account of corrosion or wear. Sealing such leaks is a challenge, and should preferably be carried out in connection with cleaning of the well.

SUMMARY OF THE INVENTION

The object of the invention is to provide an alternative device and method for cleaning and/or sealing a well, thereby reducing the drawbacks existing in the prior art.

The object is achieved according to the invention by the features set out in the following patent claims.

In this application the term drilling operation should be understood to refer to establishing a hole in a material by means of a tool string. It particularly applies to drilling a well in the earth's crust for petroleum recovery, tunnels, canals or, for example, for recovery of geothermal energy. Similarly, the term well operation in this application should be understood to refer to completion and maintenance carried out in the well after it is established.

In the following description, upper and lower refer to relative positions when the tool string is located in a vertical well. The invention, however, is not dependent on the spatial orientation of the well and the invention may be employed with advantage for construction and maintenance of, for example, horizontal wells. The present invention relates to a method of cleaning a subsurface well during a drilling operation or a well operation. A multi-channel tool string, comprising an adapter on a first end of the multi-channel tool string and a guide device at the second end of the tool string, is run into the well, with the guide device arranged to lead into the well and the adapter by an installation for initiating the operation, whereupon the guide device is activated in order to permit the well to be flushed by the supply of fluid through at least one of the channels in connection with the tool string and fluids and particles from the well are transported back to the surface through at least one other of the channels in the string.

According to an aspect of the invention at least one of the channels in the tool string is pressure tested during run-in and/or after it is run into the well. This pressure testing may be performed by means of a device which shuts off the fluid flow to the channel in one direction at a second end of the tool string. This shut-off device is either a permanent valve, or it is in the form of a movable plug valve which is moved through and out of the channel by the second end being pressurised on the opposite side.

According to another aspect the guide device may comprise at least one valve, which is operated between different modes by means of hydraulic communication between the well and the channels in the tool string, by pump pressure or by other signals from the surface. The guide device may be designed in such a manner that it goes into an open position when it opens at least two of the channels in the tool string simultaneously or time-delayed, and goes into a closed position by closing at least two of the channels in the tool string simultaneously or time-delayed. In addition the guide device may comprise a bypass valve, where the bypass valve according to the method opens up communication between at least two of the channels in the tool string when the guide device is in a closed position, and the bypass valve shuts off communication between at least two of the channels in the tool string when the guide device is in an open position. With this method solution, the invention enables internal circulation to be established in the tool string before the guide device is activated.

According to yet another aspect of the invention, the method may comprise a tool string composed of an outer string of screwed-together pipes and an inner string consisting of pipes suspended inside the outer string at suspension points in the outer pipe. In a variant the outer pipe may be attached to the guide device and inserted partially into the well, inner channels are inserted in outer pipes and placed against the guide device, whereupon a new outer pipe is screwed to the already-installed outer pipe, locking the inner channels securely in the tool string, the tool string is further inserted partially into the well and the steps are repeated. The tool string can be dismantled either by removing inner channels from outer pipes, or handling them together as a multi-channel tool string. Where there are inner channels in the outer pipe, these are screwed together, thereby joining the inner channels together.

According to a variant, an inner string of pipes connected by seals which are activated by screwing together outer pipes and an adapter on the top of the tool string (x) may lock the inner string securely in the tool string and has a built-in transmission unit for hydraulic communication to at least one of the channels in the tool string. The adapter on the top of the tool string may be provided with an electric swivel which is used for transmitting electrical signals and electric power from the surface down to tools in the well through the inner pipe string. Alternatively, the adapter on the top of the tool string may also be supplied with swivels for optical communication or extra channels with fluids, cement or chemical substances from the surface down to tools in the well through the inner pipe string.

According to a further aspect, an extension pipe, which can be attached to the tool string when it is run into the well, may be released and left in the well before the tool string is withdrawn from the well for sealing the well wall. In another variant the extension pipe may also be expanded so that it is fixed to the well wall for sealing thereof. Furthermore, at least one of the channels in connection with the tool string may be employed for injecting a sealing material for the wall of the well. In an aspect the sealing material may contain a hardening agent which reinforces the well wall after setting.

The present invention also relates to a device for cleaning a subsurface well. The device comprises a multi-channel tool string comprising an adapter at a first end of the multi-channel tool string and a guide device at a second end of the multi-channel tool string in order to guide fluid into a given return channel relative to the tool string. The multi-channel tool string may comprise a tool string with one or more concentric inner pipes arranged in an outer pipe, or alternatively there may be one or more pipes arranged inside an outer pipe, where the inner pipes can form a centre axis which is substantially parallel to the centre axis for the outer pipe, but where they extend beside each other. A variant may also be envisaged where some pipes are arranged concentrically but some others are not. The outer pipe and the internal pipes may be substantially circular in cross section, but may also have other shapes such as edged, oval, etc. and where the pipes have the same or different cross sectional shapes.

According to an aspect of the invention, a control system may be provided at an upper end of the tool string. This control system may be employed for controlling the activities carried out by the tool string, while at the same time providing communication with and between the various channels in the tool string at the upper end of the tool string.

A first end of the tool string may be arranged on board a floating or fixed installation at the earth surface. The given return channel may be composed of one or more inner pipes. In use, a second end of the tool string is located down in the well at the location in the well which requires to be cleaned. In an embodiment of the device, the given return channel may be a specially selected return channel. This return channel may also be composed of more than one channel. A variant may also be envisaged where the return channel is varied over time during use, where the return channel is chosen as the most appropriate channel for achieving the desired cleaning of the well. This means that in a period during use a channel is employed as a return channel, but later during the cleaning operation other channels are also used in addition as return channels. According to an aspect of the invention the return channel may be composed of at least one of the channels in the tool string. In another variant the annulus around the tool string may also be used as one of the return channels.

According to an aspect the device also comprises a control system which also covers an arrangement and regulating system on the surface. This includes the arrangement of lines for fluid flow and communication, together with the arrangement of valves and equipment for safe and efficient well control during the operations.

According to an aspect the guide device may comprise at least one valve arranged in connection with at least one of the channels in the drill string. According to an aspect one or more of the valves may be pressure-controlled and can open up or shut off the hydraulic communication between the well and the channels in the tool string by pump pressure or by other signals from the surface.

According to yet another aspect one or more valves in the guide device may open at least two of the channels in the tool string simultaneously or time-delayed and close at least two of the channels in the tool string simultaneously or time-delayed. In a variant one or more pressure-controlled valves may be equipped with a bypass valve, where the bypass valve opens up communication between at least two of the channels in the tool string when the pressure-controlled valve is closed, and the bypass valve shuts off communication between at least two of the channels in the tool string when the pressure-controlled valve is open. With such an arrangement it is possible to achieve internal communication between two channels in the tool string while at the same time having them closed off from the environment, thereby achieving internal circulation in the tool string. The above-mentioned pressure-controlled valves may alternatively be controlled in another way than by pressure, such as by optical or electrical signals from the surface.

According to an aspect of the invention the guide device may comprise a temporary check valve arranged for shutting off the fluid communication between two channels in one direction but opening up communication in the other direction. According to an aspect this temporary check valve may be releasably mounted in the channel, thereby shutting off fluid communication in one direction but when the fluid communication is in the other direction, the temporary valve will be transported with the fluid flow to the first end of the tool string.

According to an aspect the tool string may consist of an outer pipe string with screw connections and at least one inner pipe string with connectors which are activated by screwing together the outer pipes. The at least one inner pipe string can be kept in position relative to the outer pipe by a connecting device, where this connecting device may also form a part of the connection between the different segments of the inner pipe strings. The connections between the inner pipe segments may be hydraulically activated, mechanical or other known connecting systems that create a sealed connection, for example O-ring seals. The inner pipes are connected by the end of the one pipe being pushed into a coupling with sealing elements in the opposite pipe. With the simple solution according to the invention, a standard screwed drill string can be easily modified to form a two-channel or multi-channel drill string by means of this method. It is also conceivable for the tool string to be of the coiled tubing type with at least two channels.

According to an aspect at least one of the pipes forming the tool string with the inner channels may be electrically isolated from the rest of the tool string. In a variant the outer pipe string may be electrically isolated from the inner pipe string. This offers the possibility of transferring electrical energy through at least one of the walls of the pipe string, for example the inner pipe string.

According to another aspect the adapter at the first end of the tool string may be provided with a transmission unit, for example a swivel unit, which is employed for transmitting signals and/or electrical power from the first end to the second end of the multi-channel tool string. The signals may be electrical, optical, magnetic, etc. Alternatively or in addition the adapter may also comprise devices for transferring different types of fluid through different channels in the tool string and the environment and internally in the tool string. In a further aspect the tool string may be provided with electric motors and/or pumps which receive power from the surface through the adapter and the tool string in order to increase the efficiency of the process. Examples which may be mentioned in this connection are an electric downhole motor for rotation of drilling equipment and an electric downhole pump for pressurisation and circulation of the drilling fluid.

According to an aspect the tool string is composed of an outer string of screwed-together pipes and an inner string consisting of pipes suspended on suspension points inside the outer pipe. As an alternative, the adapter on the top of the tool string may lock the inner string securely in the tool string.

For movement of the tool string along the well path a packer may be employed, which is arranged to form a seal between the tool string and an inner wall of the well. The tool string can then be moved by means of a surface-controlled pressure differential between the top and bottom of this packer. In a variant the packer may comprise a valve device for regulating the fluid flow past the piston packing. In another variant the packer may have a built-in check valve which shuts off fluid flow from over the packer to under the packer, but which permits fluid flow from under the packer to over the packer. Furthermore, the packer may be expandable and can be activated or deactivated by a signal through the tool string or the well fluid from the surface. A valve in this packer can also be controlled in this manner.

According to an aspect of the invention the device will be activated from the surface by pressure or other control signals and the cleaning operation is generally performed in combination with other operations such as drilling, scraping, scale removal, logging and the like. The method involves "vacuuming" the well free from particles, and this can easily be done by a low-density fluid.

In a further aspect the tool string may have an outer piston packing mounted which seals the well wall continuously, or by being activated to perform such sealing by pressure or other signals through the tool string.

Furthermore, the guide device may contain an attachment device for an extension pipe, where the extension pipe is attached to the tool string when it is run into the well and can be released from the tool string by pressure or other signals from the surface before the tool string is withdrawn from the well. This guide device may be arranged so that it can be drawn through the extension pipe, thereby causing it to be expanded so that it is fixed to the well wall for sealing thereof.

The piston packing, moreover, may be provided in such a manner that it can be pushed through the extension pipe by means of pressure from the surface, thereby causing the extension pipe to be expanded so that it is fixed to the well wall for sealing thereof.

The advantages of the invention are improved efficiency for cleaning wells during drilling and well operations, better control of the pressure in the well, together with the ability to seal the well by means of an extension pipe or by injection of chemicals or materials which prevent loss of drilling fluid and reinforce the formation during drilling. The method and the device can be implemented in a simple manner for conventional drilling equipment by means of screwed drill pipes as a tool string, or alternatively employed for wholly or partially coilable tubing.

BRIEF DESCRIPTION OF THE DRAWINGS

A non-limiting example of a preferred method and embodiment will now be described and illustrated in the accompanying drawings, in which.

DETAILED DESCRIPTION

Figures 1A, 1B:
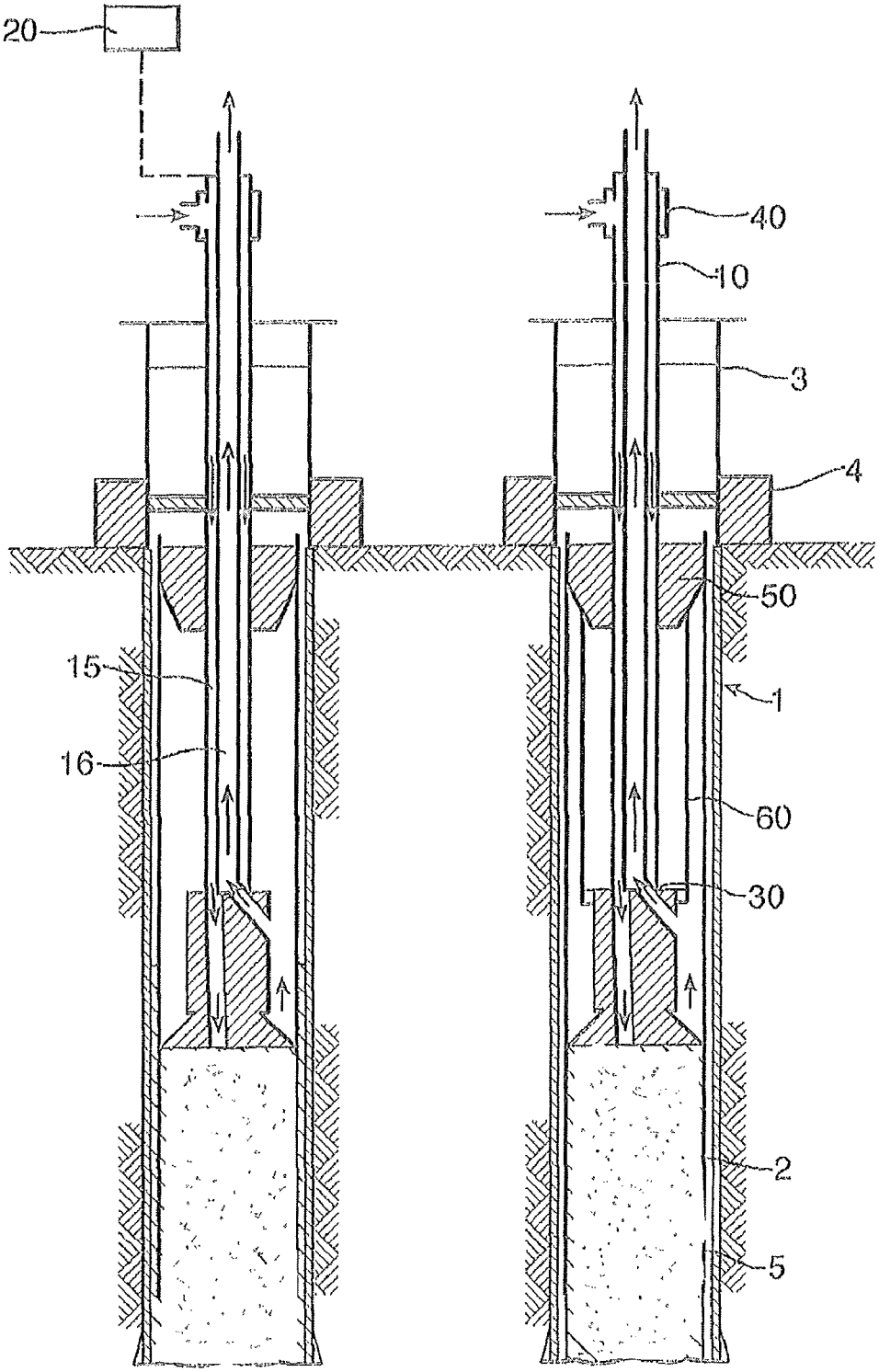
FIGS. 1A and 1B are a schematic views of an embodiment of the device according to the invention installed in a vertical well.

FIG. 1 illustrates a first and a second embodiment of a device according to the invention installed in a well. The device which is employed for washing, drilling, measuring etc. is lowered into the well 1 in order to remove material 2 in the well 1. Material 2 which is to be removed may either be new formation which has to be drilled out, or it may be deposits or other types of material which require to be removed from the well 1, either in the bottom thereof or wherever it may be required. The well 1 is generally isolated from the surrounding formation by an outer casing 5 located down in the ground. In the upper edge of the casing 5 is a blowout preventer 4 which provides a shutdown capability and a connection to a riser 3 leading up to, for example, a floating installation (not shown).

Figure 2:
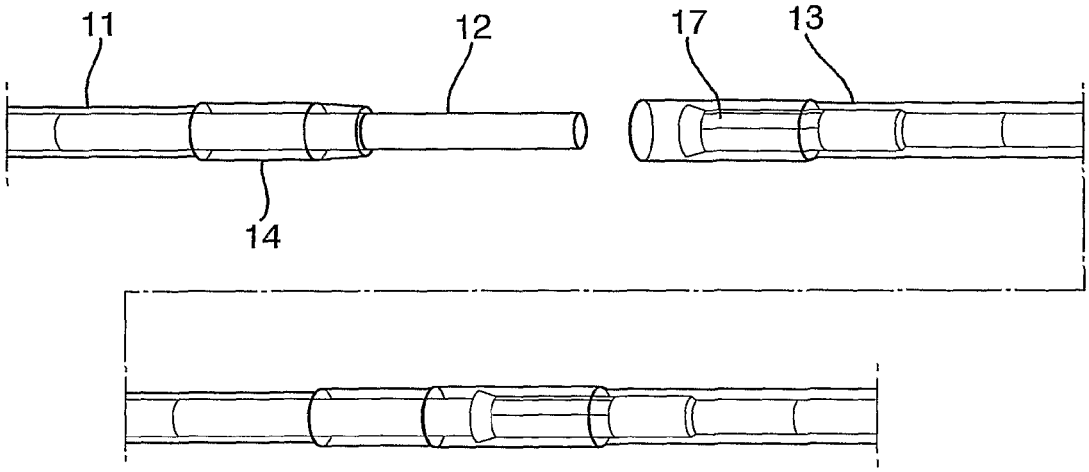
FIG. 2 is a schematic view of a two-channel tool string consisting of standard screwed drill pipes with an insert which is suspended from and affixed concentrically inside the string according to the invention.

The device according to the invention comprises a tool string 10, a control system 20, a guide device 30 at a second end of the tool string and an adapter 40 at the first end of the tool string 10. The tool string may be composed of various types of multichannel tool strings. A particularly advantageous embodiment, however, is the string depicted in FIG. 2, consisting of standard drill pipes 11, with inner pipe 12 suspended in the pipe connection at a connecting element 13. When the outer pipes 11 are screwed together by a screw connection, the inner pipe 12 is pushed into a coupling 17 with hydraulic sealing, which prevents leakage between the two channels, the central channel 16 and the annulus formed between the inner pipe 12 and the outer pipe 11, in the connected pipe. The inner pipe 12 may be arranged electrically isolated from the outer pipe 11, thereby permitting electrical signals and electrical power transmission between the surface and elements in the device through the string. The part of the inner pipe 12 which is pushed into the hydraulic seal generally has a hard and wear-resistant surface and is usually protected by a protective cover when not in use in order to prevent scraping and possible leakage.

Figure 3A:
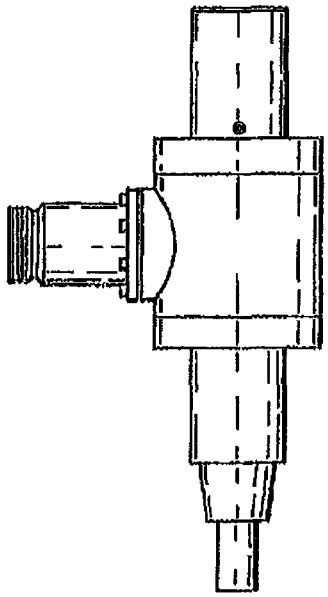
FIGS. 3A and 3B are a schematic views of an adapter which is placed on the top of the tool string, FIGS. 4A, B and C are views of a downhole pressure-controlled valve for communication between the well and the surface through the tool string.
Figure 3B:
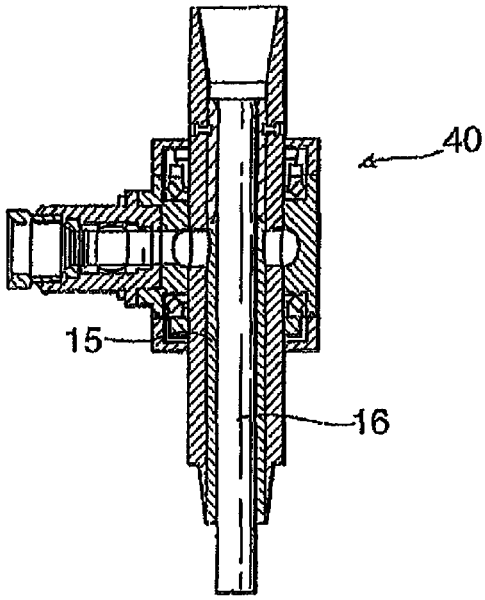

In the upper end of the tool string 10 an adapter 40 is located, see FIG. 3, with a rotary coupling which leads fluid flow into the tool string 10 from a pump on the surface (not shown in the figure). A second channel in the adapter leads fluid flow out of the tool string 10 into a separate channel of a not shown valve system, tank and subsequent cleaning of the fluid on the surface. An additional transmission unit (not shown) may be mounted on the adapter 40 for transmitting electrical signals/current, optical or other communication or alternative power transmission through the tool string to sensors or actuators in the well. The adapter 40 may also be supplied with more fluid channels (not shown) if so desired.

Figures 4A, 4B, 4C:
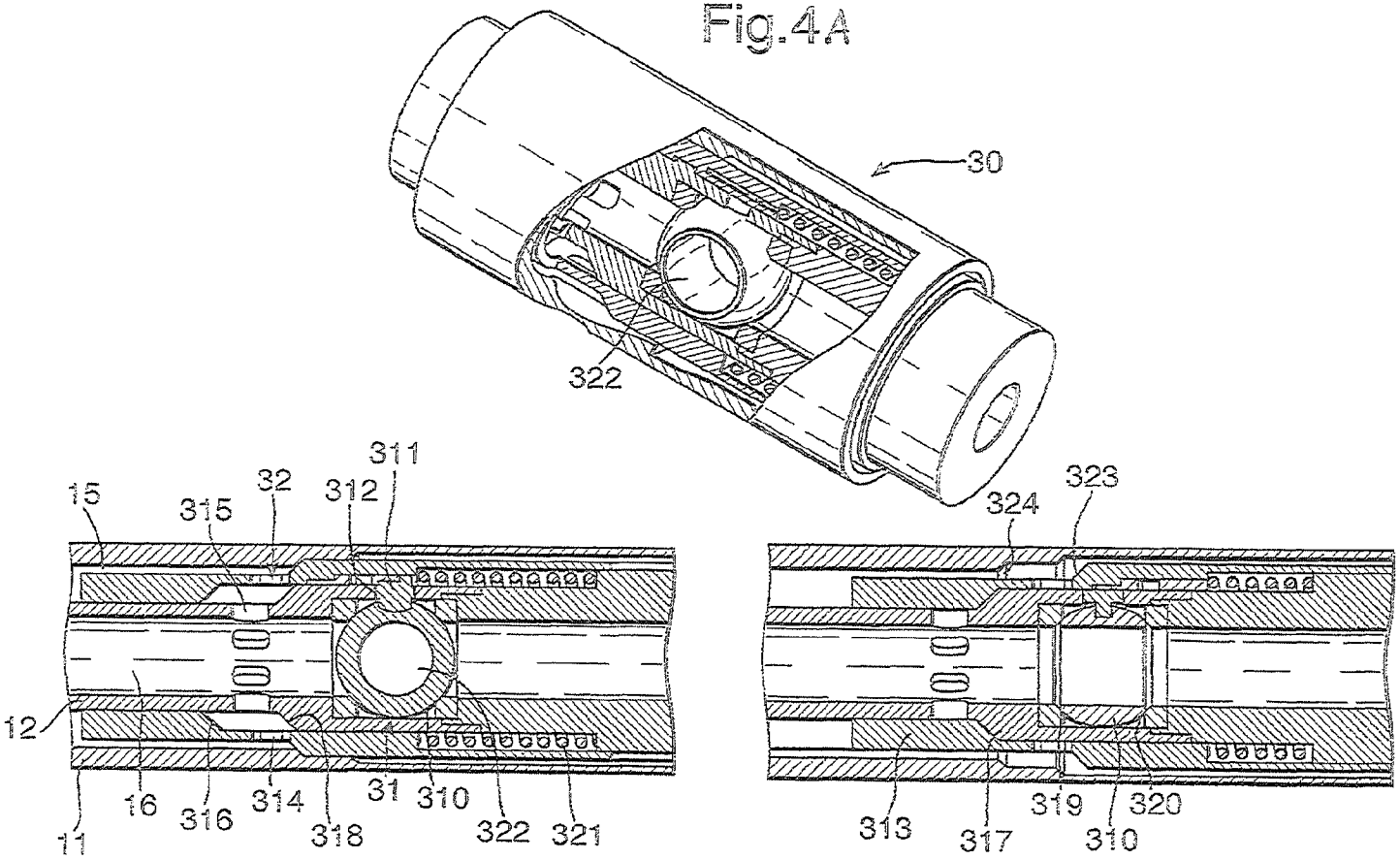

In the lower end of the tool string 10 a guide device 30 is located comprising a pressure-controlled valve 31, see FIG. 4, which allows the fluid to pass if the pressure of the fluid pumped down is greater than the ambient pressure in the well 1. This valve 31 opens up and shuts off the central channel 16 and the annulus 15 simultaneously, thereby providing both supply and return flow by means of the pressure control of the valve 31. The result is that when the valve opens, the return flow channel opens simultaneously, and when the valve closes, the return flow channel closes simultaneously. In an embodiment the supply and return channels may be supply in the annulus 15 and return in the central channel 16.

In addition the pressure-controlled check valve may be arranged in combination with a third bypass valve, see FIG. 4, for a channel between the return flow channel and the channel for flow into the well. This bypass valve 32 is controlled by means of its shape, with the result that the bypass valve is open when the pressure-controlled valve 31 is closed, and the bypass valve 32 is closed when the pressure-controlled valve 31 is open. The pressure-controlled valve may be a check valve. A possible physical embodiment for the guide device with the two valves is to mount a ball body 310 in a valve housing 317, where the valve housing is connected to the inner pipe 12 and where the ball body 310 opens and closes the central channel 16. The ball body is provided with a guide pin 311, extending in a guide track 312, where the guide track 312 is provided in a guide sleeve 313 arranged substantially round the internally located valve housing 317. An axial movement of the guide sleeve 313 will rotate the ball body 310 at guide groove 312 and guide pin 311, with the result that a through-going bore 322 through the ball body 310 is either arranged in line with the central channel or closes it. The ball body 310 is provided with an outer sealing surface 320 abutting sealing surfaces 319 provided in the valve housing 317. The guide sleeve 313 further comprises through-going holes 314 and an abutment surface 316. The valve housing 318 also comprises through-going holes 315 which in a position of the valve provide communication between the annulus 15 and the central passage 16 at one side of the ball body 130, thereby enabling internal circulation to be established between the central passage 16 and the annulus 15. The valve housing also has an external abutment surface 318 which, when it is an abutment against the abutment surface 316 of the guide sleeve, in the event of an axial movement thereof, will provide a sealing abutment and shut off the communication between the annulus 15 and the central passage 16 via the through-going holes 314, 315. Furthermore, the guide sleeve 313 is prestressed by an elastic element 321 in abutment between a shoulder on the valve housing 317 and a surface of the guide sleeve 313 with the result that in an unloaded state the valve will displace the guide sleeve 313 thereby causing the ball body 130 to close the central passage and an outer abutment surface 323 of the guide sleeve to be located in abutment against an internal abutment surface of the outer pipes 11, thereby closing the annulus passage 15. At the same time the holes 314, 315 will be located in alignment with each other, providing fluid communication between the annulus 15 and the central passage 16.

In this way, continuous circulation will be permitted inside the double tool string during a drilling operation, even though both channels through the pressure-controlled check valve are closed. The pressure-controlled check valve 31 may be duplicated or replaced by corresponding valves controlled by signals from the surface, for example of an electrical nature as described earlier. This is in order to increase safety and reliability by means of redundancy in the system for well control.

Figure 5:
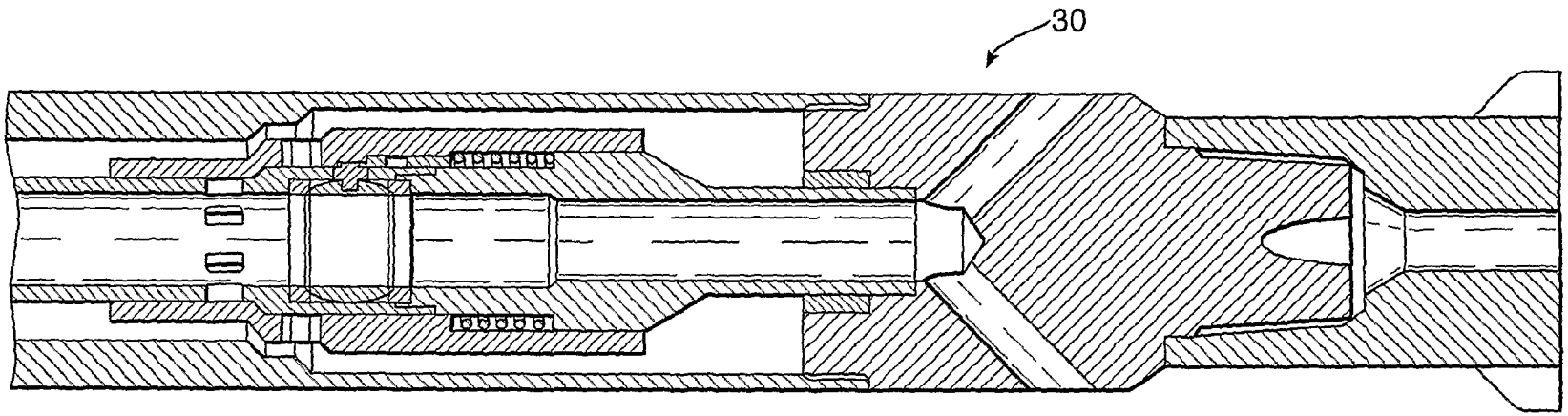
FIG. 5 illustrates a downhole pressure-controlled valve in combination with "Flow x-over", which guides the fluid flow from the well into a channel in the tool string.

Under the pressure-controlled check valve 31 a "flow x-over" tool is usually arranged to lead the fluid flow from the well into the return flow channel in the tool string, see FIG. 5. Under this flow x-over tool, standard washing equipment, pumps, drilling equipment and measuring equipment of a known type may be employed. It is also possible to provide such equipment with electric power through the tool string, as described above.

Figure 6:
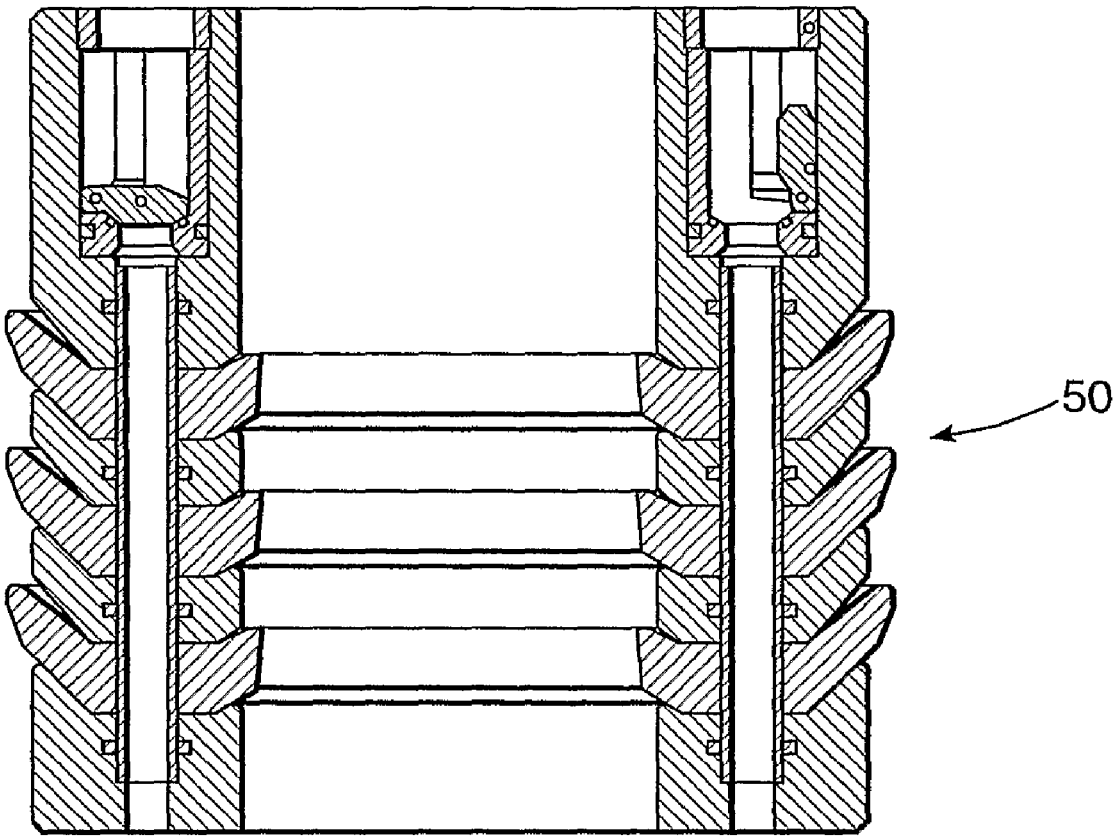
FIG. 6 is a schematic view of a downhole piston packing which is used to apply downhole forces for propulsion of the tool string, and is used for pressure control and safety of the well.

On the tool string 10 a piston packing 50 may be placed, see FIG. 6, to permit transport of the tool in and out of the hole by regulating the differential pressure across the piston packing from the surface. The piston packing will thereby act as a "tractor" for transporting the tool in or out of the wellbore. This is particularly important in wells with a large angular deviation from the vertical direction, such as horizontal wells.

During the operation an extension pipe 60 may be installed in the well, where the extension pipe is arranged as a part of the tool string under the piston packing 50. The extension pipe 60 will increase the flexural strength in order to prevent buckling, thereby improving the propulsion during the operation, particularly in horizontal boreholes. The extension pipe 60 may be left in the well after the end of the operation, for reinforcing or sealing the well against the environment, and it may be of the expandable type, being expanded against the well wall by pressure or mechanical tools during or after completion of the operation, in order to reduce the restriction in the well. The expansion tool may be a part of the piston packing and be pushed through the extension pipe by pressure from the surface through the annulus on the outside of the tool string, and/or it may be a part of the guide device and be drawn through the extension pipe for expansion thereof. The expansion tool may consist of units with longitudinal holes or rollers, which roll out the extension pipe with little frictional resistance to a given diameter during the expansion process.

The invention has now been explained with reference to the attached drawings. A number of technical variations may be made to the illustrated embodiment which will fall within the scope of the invention as defined in the attached claims.

The invention claimed is:

1. A method of cleaning a subsurface well, comprising:

running a multi-channel tool string comprising an adapter on a first end of the tool string and a guide device at a second end of the tool string into the well before the guide device permits the well to be flushed, the tool string having at least two channels extending from the first end of the tool string to the second end of the tool string, the guide device comprising a pressure-controlled valve that controls fluid communication between the at least two channels of the tool string and the well, wherein the guide device is in an open position to permit the well to be flushed when the pressure-controlled valve is open, wherein the pressure-controlled valve is configured to open in response to a select pressure of a fluid pumped down the tool string;

activating the guide device to permit the well to be flushed;

supplying fluid through one of the at least two channels in connection with the tool string; and transporting fluids and particles from the well back to the surface through the other of the at least two channels in connection with the tool string;

wherein an extension pipe which was attached to the tool string when the tool string was run into the well is released and left in the well before the tool string is withdrawn from the well for sealing the wall of the well.

2. The method according to claim 1, wherein at least one of the channels in the tool string is pressure-tested during and/or after the tool string is run into the well.

3. The method according to claim 1, wherein the pressure-controlled valve is arranged to open the at least two channels in the tool string simultaneously or time-delayed and shut off the at least two channels in the tool string simultaneously or time-delayed.

4. The method according to claim 3, wherein the guide device further comprises at least one bypass valve, wherein the at least one bypass valve opens up communication between the at least two channels in the tool string when the guide device is in a closed position, and wherein the at least one bypass valve shuts off communication between the at least two channels in the tool string when the guide device is in the open position.

5. The method of claim 4, further comprising establishing internal circulation in the tool string before activating the guide device to permit the well to be flushed.

6. The method according to claim 1, wherein power and signals of an electrical, optical or electromagnetic type are transmitted through the adapter and the tool string for measurement, control and power supply to equipment in the tool string.

7. The method according to claim 1, wherein an outer piston packing is mounted in the tool string for sealing off the wall of the well and for pushing the tool string inwards in the well by pumping fluid from the surface into the annulus of the well outside the tool string.

8. The method according to claim 1, wherein the extension pipe is expanded so that it is fixed to the wall of the well for sealing thereof.

9. The method according to claim 1, wherein at least one of the channels in connection with the tool string is employed for injecting a sealing material for the wall of the well.

10. The method according to claim 9, wherein the sealing material sets and reinforces the wall of the well after setting.

11. The method of claim 1, wherein the pressure-controlled valve opens if the select pressure is greater than an ambient pressure in the well.

12. A device for cleaning a subsurface well, comprising:

a multi-channel tool string having at least two channels extending from a first end of the tool string to a second end of the tool string, wherein one of the at least two channels is a return channel;

an adapter at the first end of the tool string; and a guide device at the second end of the tool string for guiding fluid into the return channel in connection with the tool string, the guide device comprising at least one pressure-controlled valve arranged in connection with at least one of the channels in the tool string and configured to open in response to a select pressure of a fluid pumped down the tool string;

wherein the guide device contains a fastening device for an extension pipe, wherein the extension pipe is attached to the tool string when the tool string is run into the well and can be released from the tool string by pressure or other signals from the surface before the tool string is withdrawn from the well.

13. The device according to claim 12, wherein the at least one pressure-controlled valve is arranged to open at least two of the channels in the tool string simultaneously or time-delayed and shut off at least two of the channels in the tool string simultaneously or time-delayed.

14. The device according to claim 12, wherein the return channel is composed of at least one of the channels inside the tool string.

15. The device according to claim 12, wherein an outer piston packing is mounted on the tool string for continuous sealing of the wall of the well.

16. The device according to claim 12, wherein the guide device is arranged so that the guide device can be drawn through the extension pipe, thereby causing the latter to be expanded so that it is fixed to the well wall for sealing thereof.

17. The device according to claim 12, wherein a piston packing is arranged in such a manner that it can be pushed through the extension pipe by pressure from the surface, causing the extension pipe to be expanded so that it is fixed to the well wall for sealing thereof.

18. The device of claim 12, wherein the at least one pressure-controlled valve opens if the select pressure is greater than an ambient pressure in the well.

19. The device of claim 12, wherein the guide device further comprises a bypass valve, wherein the bypass valve opens up communication between the channels in the tool string when the at least one pressure-controlled valve is closed, and wherein the bypass valve shuts off communication between the channels in the tool string when the at least one pressure-controlled valve is open.

* * * * *